US008003891B2

(12) United States Patent
Rocks et al.

(10) Patent No.: US 8,003,891 B2
(45) Date of Patent: Aug. 23, 2011

(54) HIGH-VOLTAGE OUTDOOR BUSHING

(75) Inventors: Jens Rocks, Freienbach (CH); Vincent Tilliette, Zurich (CH); Walter Odermatt, Hunzenschwil (CH); Willi Gerig, Othmarsingen (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 12/766,158

(22) Filed: Apr. 23, 2010

(65) Prior Publication Data

US 2010/0206604 A1 Aug. 19, 2010

Related U.S. Application Data

(63) Continuation of application No. PCT/EP2008/061867, filed on Sep. 8, 2008.

(30) Foreign Application Priority Data

Oct. 26, 2007 (EP) ..... 07119369

(51) Int. Cl.
*H01B 17/26* (2006.01)

(52) U.S. Cl. ..... 174/152 R; 174/142; 174/137 R; 174/73.1; 16/2.2

(58) Field of Classification Search ..... 174/73.1, 174/74 R, 76, 77 R, 80, 137 R, 138 R, 142, 174/152 R, 11 BH, 12 BH, 14 BH, 143, 650, 174/18; 16/2.1, 2.2; 248/56; 439/604, 587, 439/274, 275; 385/138; 337/202
See application file for complete search history.

(56) References Cited

U.S. PATENT DOCUMENTS

| | | | | |
|---|---|---|---|---|
| 3,953,815 | A * | 4/1976 | Raupach | 174/18 |
| 4,272,642 | A * | 6/1981 | Classon | 174/142 |
| 4,818,967 | A * | 4/1989 | Mikulecky | 337/202 |
| 6,441,310 | B1 * | 8/2002 | Niedermier et al. | 174/138 R |
| 6,534,721 | B2 * | 3/2003 | Hoefner | 174/158 R |
| 7,262,367 | B2 * | 8/2007 | Donzel et al. | 174/142 |
| 7,825,331 | B2 * | 11/2010 | Allais et al. | 174/152 R |
| 2007/0158106 | A1 | 7/2007 | Tilliette et al. | |
| 2007/0272432 | A1 | 11/2007 | Isberg et al. | |
| 2008/0179077 | A1 | 7/2008 | Krivda et al. | |
| 2009/0014211 | A1 | 1/2009 | Tilliette et al. | |

FOREIGN PATENT DOCUMENTS

| | | |
|---|---|---|
| EP | 1 284 483 A1 | 2/2003 |
| EP | 1 622 173 A1 | 2/2006 |
| EP | 1 798 740 A1 | 6/2007 |
| GB | 537268 | 12/1939 |

(Continued)

OTHER PUBLICATIONS

International Search Report for PCT/EP2008/061867 completed Mar. 9, 2009.

(Continued)

*Primary Examiner* — Angel R Estrada
(74) *Attorney, Agent, or Firm* — Buchanan Ingersoll & Rooney PC

(57) ABSTRACT

An exemplary high-voltage outdoor bushing is disclosed which includes a conductor extended along an axis, a condenser core and an electrically insulating polymeric weather protection housing molded on the condenser core. The condenser core can contain an electrically insulating tape which is wound in spiral form around the conductor. Capacitance grading insertions can be arranged between successive windings of the tape. A cured polymeric insulating matrix embeds the wound tape and the capacitive grading insertions. A moisture diffusion barrier can be incorporated inside the condenser core prior to molding the weather protection housing.

16 Claims, 1 Drawing Sheet

FOREIGN PATENT DOCUMENTS

| | | | |
|---|---|---|---|
| WO | WO 2005/006355 | A1 | 1/2005 |
| WO | WO 2006/131011 | A1 | 12/2006 |

OTHER PUBLICATIONS

Written Opinion for PCT/EP2008/061867 completed Mar. 9, 2009.

Notification Concerning Transmittal of International Preliminary Report on Patentability (Forms PCT/IB/326 and PCT/IB/373) and the Written Opinion of the International Searching Authority (Form PCT/ISA/237) issued in corresponding International Application No. PCT/EP2008/061867 dated May 6, 2010.

* cited by examiner

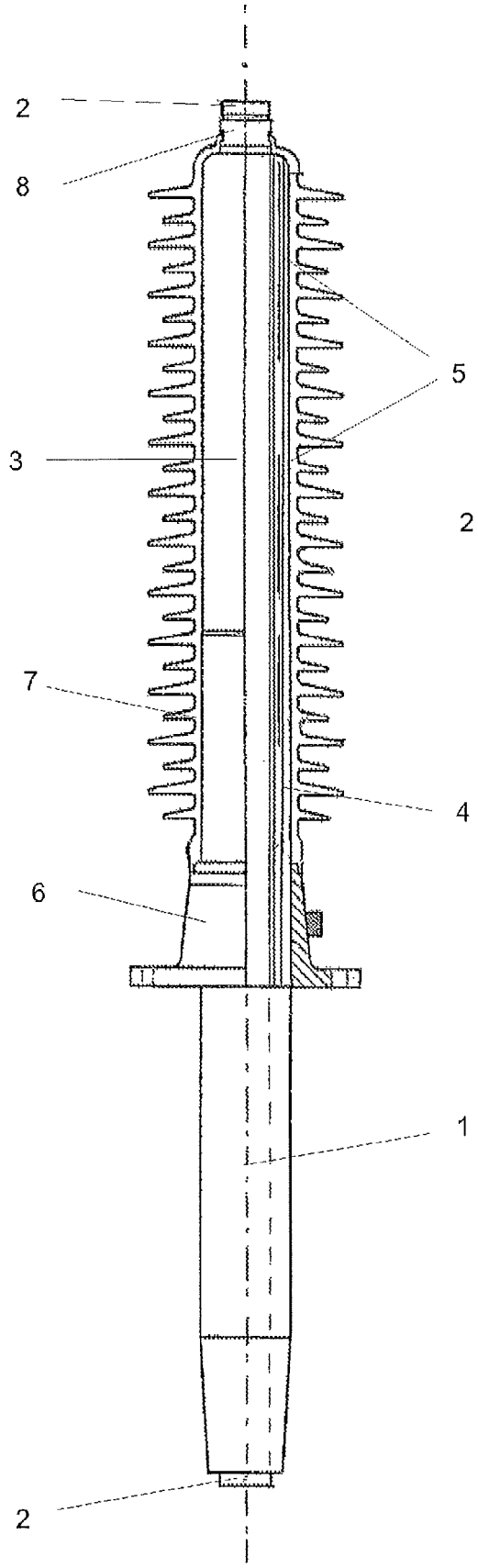
2
8
5
3
2
7
4
6
1
2

HIGH-VOLTAGE OUTDOOR BUSHING

RELATED APPLICATIONS

This application claims priority as a continuation application under 35 U.S.. §120 to PCT/EP2008/061867 which was filed as an International Application on Sep. 8, 2008 designating the U.S., and which claims priority to European Application 07119369.2 filed in Europe on Oct. 26, 2007. The entire contents of these applications are hereby incorporated by reference in their entireties.

FIELD

The disclosure relates to the field of high-voltage technology.

BACKGROUND INFORMATION

High-voltage outdoor bushings are known which include a conductor extended along an axis, a condenser core and an electrically insulating polymeric weather protection housing molded on the condenser core. The condenser core can contain an electrically insulating tape which is wound in spiral form around the conductor, capacitance grading insertions arranged between successive windings of the tape and a cured polymeric insulating matrix embedding the wound tape and the capacitive grading insertions. Such a bushing can be used in high voltage technology, such as in switchgear installations or in high-voltage machines, like generators or transformers, for voltages up to several hundred kV (for example, voltages between 24 and 800 kV).

A high-voltage outdoor bushing is a component that can be used to carry current at high potential from an encapsulated active part of a high-voltage component, like a transformer or a circuit breaker, through a grounded barrier, like a transformer tank or a circuit breaker housing, to a high-voltage outdoor line. In order to decrease and control the electric field the outdoor bushing includes a condenser core which facilitates the electrical stress control through floating capacitance grading insertions, which are incorporated in the condenser core. The condenser core decreases the electric field gradient and distributes the electric field homogeneously along the length of the bushing.

The condenser core of the bushing can be wound from kraft paper or creped kraft paper as a spacer. The capacitance grading insertions are executed as either metallic (e.g., aluminium) sheets or non-metallic (e.g., ink, graphite paste) patches. The insertions are located coaxially so as to achieve an optimal balance between external flashover and internal puncture strength. The paper spacer ensures a defined position of the insertions and the mechanical stability of the condenser core. The condenser core is impregnated with resin (RIP, resin impregnated paper). The resin is then introduced during a heating and vacuum process of the core. Such a RIP outdoor bushing can have an advantage that it is dry (oil free).

The outdoor bushing includes an outdoor side with an insulator made of either porcelain or a weather-resistant polymeric material, for example, on the basis of silicone or of epoxide, having sheds which ensure the creepage distance for withstand voltages under all operation conditions. The porcelain has been used as insulation material, however, there is a continuously growing desire for polymeric insulation. The desire for polymeric insulation is mainly based on the fact that polymeric insulators have the additional benefit of being hydrophobic (water repellent) which leads to a self cleaning property, and which thus extends service life and lowers significantly substation maintenance costs. Moreover, the silicone intrinsic hydrophobic property helps to break up water films and to create separate droplets which reduce leakage currents, prevent flashover and elevate the voltage withstand capability in wet and highly contaminated conditions, which exist in coastal or highly polluted environments. Furthermore, a bushing with polymeric insulation is lightweight and resistant against vandalism and earthquake. Besides such a bushing is explosion proof. Thus a scattering of a rigid insulating housing, for example, of a porcelain insulator, and a damage of secondary equipment is mostly excluded.

A high-voltage outdoor bushing with a conductor extended along an axis, a condenser core coaxially surrounding the conductor and with an electrically insulating polymeric weather protection housing is described in EP 1 284 483 A1. The weather protection housing is manufactured from a silicone and is directly molded on the outer surface and the high-voltage front face of the condenser core and is extended to a part of the surface of the conductor, which is not covered from the condenser core. A bushing cap which protects the high-voltage side against the weather becomes no longer necessary and thus the bushing can be manufactured with low costs. However, directly molded outdoor bushings have shown to generate significant problems during storage and operation. The dissipation factor tan δ has increased considerably during extended periods of storage and operation.

Further high-voltage outdoor bushings which respectively include a conductor extended along an axis and a condenser core coaxially surrounding the conductor are disclosed in EP 1 622 173 A1, EP 1 798 740 A1 and WO 2006/131011 A1. These bushings respectively include a composite insulator as weather protection housing which is designed as a prefabricated rigid housing. The rigid housing receives the prefabricated condenser core and the conductor and is closed by a cap and a mounting flange.

The production of the condenser core includes winding an insulating tape onto the conductor, adding capacitance grading insertions during winding between successive layers of the tape, placing the wound tape into a mold, applying a vacuum to a mold and impregnating the evacuated wound tape with an insulating material consisting of a polymer which is loaded with an inorganic filler powder. Afterwards the impregnated wound tape is cured. The resulting condenser core is cooled down and machined if desired. In order accelerate the impregnation, at least one of the layers of the tape (EP 1 622 173 A1) and/or one of the capacitance grading insertions (EP 1 798 740 A1) includes holes and/or the tape contains the inorganic filler particles which are pre-filled into the tape before execution of the impregnation process with the unfilled polymer (WO 2006/131011 A19).

Such high-voltage outdoor bushings can be expensive since the composite insulators are manufactured separately and include a bushing cap. Furthermore, electrically insulating material is used for filling gaps and pores within the bushing housings and for preventing electrical discharges and failures in the bushings.

High-voltage outdoor bushings with a condenser core of a moisture absorbing (e.g., hygroscopic) material are known from WO 2005/006355 A and GB 537 268 A. In these bushings the moisture uptake in the condenser core can be addressed by a diffusion barrier which is applied to the surface of the core and which includes a film having low water permeability, such as a solid moisture-proof skin.

SUMMARY

A high-voltage outdoor bushing is disclosed comprising: a conductor extended along an axis; a condenser core; an electrically insulating polymeric weather protection housing molded on the condenser core, wherein the condenser core contains an electrically insulating tape which is wound in spiral form around the conductor; capacitance grading insertions arranged between successive windings of the tape; a cured polymeric insulating matrix embedding the wound tape and the capacitive grading insertions; and a moisture diffusion barrier which is incorporated inside the condenser core prior to molding the weather protection housing.

BRIEF DESCRIPTION OF THE DRAWINGS

There is shown in the FIGURE an exemplary embodiment of a high-voltage outdoor bushing according to the disclosure, with an axial partial section through the bushing on the right.

The reference signs used in the FIGURE and their meaning are summarized in a list of reference signs. Generally, alike or alike-functioning parts are given the same reference symbols. The described embodiment is meant as example and shall not confine the disclosure.

DETAILED DESCRIPTION

A high-voltage outdoor bushing is disclosed which can be manufactured in an easy and economic manner and which at the same time during operation, even under severe weather conditions, can be distinguished by a long storage and operation life time and a high reliability.

An exemplary high-voltage outdoor bushing according to the disclosure includes a moisture diffusion barrier which is incorporated inside the condenser core prior to molding a polymeric weather protection housing. Such a bushing can exhibit an excellent storage and operation stability under hot and wet weather conditions. This is due to the fact that, for example, the moisture diffusion barrier limits moisture to enter deeply into the condenser core. Otherwise the moisture after having migrated through the polymeric weather protection housing by way of diffusion can migrate deeply into the condenser core and can then affect the electrical properties of the bushing, for example, the dissipation factor, strongly.

In a exemplary embodiment of a bushing according to the disclosure the moisture diffusion barrier includes at least a part of the insulating matrix which is loaded with an inorganic filler powder. The particles of the filler power can significantly reduce the diffusion coefficient of the condenser core since the filler particles of the inorganic filler powder reduce the effective length of the diffusion path of water molecules. Thus in a very simple way, moisture can be addressed (e.g. remarkably prevented) from entering the condenser core. The bushing can be manufactured easily and at the same time the storage and operation stability of the bushing even under hot and wet environmental conditions can be significantly enhanced.

In order to get a very effective barrier against the penetration of water, the polymer can be highly charged with the inorganic filler particles. A bushing with a comparatively high operation and storage life time under moderate weather conditions can be achieved when the filler includes, for example, at least about 20% more or less, preferably at least 30% by volume of the material of the matrix before curing. A bushing with a high operation and storage life time even under severe weather conditions is achieved when the filler comprises, for example, between 40 and 50% more or less by volume of the material of the matrix before curing.

In order to achieve a dense and thus an effective moisture diffusion barrier the filler powder has two fractions of particles with different average sizes, of which the particles in the first fraction have a larger average diameter than the particles in the second fraction and are arranged essentially in the form of close sphere packing and the particles in the second fraction fill the interstices formed by the sphere packing. A tight filling can be achieved if the average diameter of the particles in the second fraction is, for example, from about 10 to about 50% of the average diameter of the particles in the first fraction and if the quantity of the second fraction is, for example, from about 5 to about 30% by volume of the amount of the first fraction. The density and thus the efficiency of the moisture diffusion barrier can be further improved if a further fraction of predominantly spherically formed particles of the filler is present, whose average diameter is, for example, from about 10 to about 50% of the diameter of the particles in the second fraction.

Water vapour which has passed the polymeric weather protection housing by diffusion can be prevented from penetrating into the condenser core to a large extent if the moisture diffusion barrier comprises a layer which frequently already exists and which causes a strong adhesive force between the condenser core and the weather protection housing. Such a layer can be in the form of an adhesion promoter on the basis of an adhesive polymer comprising a diffusion-constraining material.

The conductor can be formed as a rod, a tube or a wire.

The tape can be wound in, for example, spiral form, thus forming a multitude of neighboring layers, and can be manufactured from fibers which are arranged in form of a paper or a net. Appropriate fibers are organic or inorganic. Organic fibers can include natural fibers, like cellulose, polymeric fibers on the basis of a thermosetting, like polyester, or on the basis of a thermoplastic, like aramide (NOMEX®), polyamide, polyolefine, for instance PE, polybenzimidazole (PBI), polybenzobisoxazole (PBO), polyphenylene sulphide (PPS), melamine and polyimide. Inorganic fibers can include glass, lava, basalt and alumina. The paper can be, for example, a crepe paper or a paper comprising holes. The matrix material then can be distributed very fast and homogeneous in the condenser core. A fast and homogeneous distribution of the matrix material is also achieved, when the tape contains filler powder particles which are pre-filled into the tape or the insulating matrix before impregnating the wound tape with an uncured polymer.

The capacitance grading insertions can be inserted into the core after certain numbers of windings, so that the capacitance grading insertions can be arranged in a well-defined, radial distance to the axis. The capacitance grading insertions can be interspersed with openings, which facilitate and accelerate the penetration of the wound tape with the matrix material.

The combination of spacer and capacitance grading insertions can facilitate and accelerate the impregnation of the wound tape with matrix material considerably.

The polymer can, for example, be a resin on the basis of a silicone, an epoxy, such as a hydrophobic epoxy, an unsaturated polyester, a vinylester, a polyurethane or a phenol. For example, the filler particles can be electrically insulating or semiconducting. The filler particles can be particles of $SiO_2$, $Al_2O_3$, BN, AlN, BeO, $TiB_2$, $TiO_2$, SiC, $Si_3N_4$, $B_4$, ZnO or the like, or mixtures thereof. It is also possible to have a mixture of various such particles in the polymer.

Further advantages and applications of the disclosure are given in a drawing and in a part of the description which follows.

The exemplary bushing shown in the FIGURE is substantially rotationally symmetric with respect to a symmetry axis 1. In the center of the bushing is arranged a columnar supporting body 2, which can be a solid metallic rod or a metallic tube. The exemplary metallic rod is an electric conductor 2 which connects an active part of an encapsulated device, for instance a transformer or a switch, with an outdoor component, for instance a power line. If the supporting body 2 is formed as a metallic tube, this tube can also be used as electric conductor 2, but can also receive an end of a cable, which is guided from below into the tube and the current conductor of which is electrically connected to part 2.

The conductor 2 can be partially surrounded by a core 3, which also is substantially rotationally symmetric with respect to the symmetry axis 1. The core 3 can include an insulating tape 4 (shown on the right of the FIGURE), which is wound around the conductor 2 and which is impregnated with a cured matrix material on the base of a polymer filled with an inorganic filler powder. The filler powder can include, for example, approximately 45% by volume of the matrix material before curing. Capacitance grading insertions 5 (shown on the right of the FIGURE) can be arranged between adjacent windings of the tape 4.

On the outside of the core 3, a foot flange 6 can be provided, which allows fixing of the bushing to a grounded enclosure of the encapsulated device. Under operation conditions, the conductor 2 can be on high potential, and the condenser core 3 can ensure the electrical insulation between the conductor 2 and the flange 6. On that side of the bushing, which can be located outside of the grounded enclosure an electrically insulating weather protection housing 7 surrounds the core 3.

The weather protection housing 7 can be manufactured from a polymer on the basis of a silicone or a hydrophobic epoxy resin. The housing 7 can include sheds and can be molded on the condenser core 3 such that it extends from the top of the foot flange 6 along the adjoining outer surface of the condenser core 3 to the upper end 8 of the conductor 2. An adhesive layer which can be deposited on covered surfaces of the parts 2, 3 and 6 to, for example, improve adhesion of the housing 7. The housing protects the condenser core 3 from ageing caused by radiation (UV) and by weather and maintains good electrical insulating properties during the entire life of the bushing. The shape of the sheds can be designed such that it has a self-cleaning surface when it is exposed to rain. This can avoid dust or pollution accumulation on the surface of the sheds, which could affect the insulating properties and lead to electrical flashover.

The tape 4 is executed as a net on the basis of a polyester. The matrix material comprises, as an exemplary polymer, an epoxy resin which was cured with an anhydride and as filler powder fused silica. The sizes of the fused silica particles are up to, for example, 64 μm and comprise three fractions with an average particle sizes of, for example, 2, 12 and 40 μm respectively.

An exemplary bushing according to the FIGURE and a reference bushing were stored in tap water at 25±3°. Both bushings were totally immersed in the tap water. The reference bushing differed from the bushing disclosed herein in the material of the tape and in the material of the matrix. The tape of the reference bushing was as crepe paper. The matrix of the reference bushing had the same polymer as the matrix of the bushing according to the disclosure, but without a filler powder. From time to time the bushings were removed from the water, blown with compressed air and dried in air for 2 or 3 hours. Afterwards the dissipation factor tan δ of the two bushing was measured in accordance with IEC 60137 at a frequency of 50 Hz.

The results of the measurements are shown in the table below.

| Storage time [hours] | Tan delta reference bushing [%] | Tan delta inventive bushing [%] |
|---|---|---|
| 0 | 0.38 | 0.11 |
| 65 | 6.26 | 0.14 |
| 110 | 12.92 | 0.14 |
| 227 | 17.75 | 0.14 |
| 387 | 43.16 | 0.48 |
| 573 | 30.85 | 0.44 |
| 691 | 45.48 | 0.49 |
| 923 | 48.21 | 0.52 |
| 1183 | 54.52 | 0.50 |
| 1848 | 76.42 | 0.56 |
| 2489 | 119.60 | 0.53 |

The table shows that the exemplary bushing according to the disclosure even after a storage period of more than a hundred days under severe storage conditions had a dissipation factor smaller 1%. Furthermore, the dissipation factor reached this small value already after a few weeks and remained nearly constant until this time. On the other side the dissipation factor of the reference bushing after a few weeks reached a value which was a factor 100 higher than the corresponding value of the bushing according to the disclosure and which still increased considerably with time.

Thus the matrix material of the condenser core of the exemplary bushing according to disclosure acts as a moisture diffusion barrier which limits the diffusion of water molecules into the interior of the condenser core to a large extent and which is responsible that the bushing according to the disclosure maintains to a large extent a low dissipation factor even under strong external conditions.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 axis
2 conductor
3 core
4 tape
5 capacitance grading insertions
6 foot flange
7 weather protection housing
8 upper end of conductor 2

What is claimed is:

1. High-voltage outdoor bushing, comprising:

a conductor extended along an axis;

a condenser core;

an electrically insulating polymeric weather protection housing molded on the condenser core, wherein the condenser core contains an electrically insulating tape which is wound in spiral form around the conductor;

capacitance grading insertions arranged between successive windings of the tape;

a cured polymeric insulating matrix embedding the wound tape and the capacitive grading insertions; and a moisture diffusion barrier which is incorporated inside the condenser core prior to molding the weather protection housing.

2. Bushing according to claim 1, wherein the moisture diffusion barrier comprises:

at least a part of the insulating matrix which is loaded with an inorganic powder filler.

3. Bushing according to claim 2, wherein the filler comprises:

at least 20% by volume of the material of the matrix before curing.

4. Bushing according to claim 3, wherein the filler comprises:

two fractions of particles with different average sizes, of which the particles in a first fraction have a larger average diameter than particles in a second fraction and are arranged essentially as sphere packing, the particles in the second fraction filling interstices formed by the sphere packing.

5. Bushing according to claim 4, wherein an average diameter of the particles in the second fraction is from about 10 to about 50% of the average diameter of the particles in the first fraction.

6. Bushing according to claim 5, wherein a quantity of the second fraction is from about 5 to about 30% by volume of an amount of the first fraction.

7. Bushing according to claim 4, comprising:

at least one further fraction of predominantly spherically formed particles whose average diameter is from about 10 to about 50% of the average diameter of the particles in the second fraction.

8. Bushing according to claim 2, wherein an amount and size of the filler is selected such that after immersing the bushing for more than 1000 hours in water at 25°, a dissipation factor of the bushing at a frequency of 50 Hz remains smaller 1%.

9. Bushing according to claim 1, wherein the tape and/or at least one of the capacitance grading insertions comprises:

holes which generate an open cell structure and which are filled with the insulating matrix; and/or the tape contains powder filler particles which are pre-filled into the tape before impregnating the wound tape with an uncured polymer of the insulating matrix.

10. Bushing according to claim 1, wherein the moisture diffusion barrier comprises:

a layer which causes a strong adhesive force between the condenser core and the weather protection housing.

11. Bushing according to claim 10, wherein the layer is an adhesion promoter based on an adhesive polymer comprising:

a diffusion-constraining material.

12. Bushing according to claim 2, wherein the filler comprises:

between 40 and 50% by volume of the material of the matrix before curing.

13. Bushing according to claim 6, comprising:

at least one further fraction of predominantly spherically formed particles whose average diameter is from about 10 to about 50% of the average diameter of the particles in the second fraction.

14. Bushing according to claim 7, wherein an amount and size of the filler is selected such that after immersing the bushing for more than 1000 hours in water at 25°, a dissipation factor of the bushing at a frequency of 50 Hz remains smaller 1%.

15. Bushing according to claim 14, wherein the tape and/or at least one of the capacitance grading insertions comprises:

holes which generate an open cell structure and which are filled with the insulating matrix; and/or the tape contains powder filler particles which are pre-filled into the tape before impregnating the wound tape with an uncured polymer of the insulating matrix.

16. Bushing according to claim 15, wherein the moisture diffusion barrier comprises:

a layer which causes a strong adhesive force between the condenser core and the weather protection housing.

* * * * *